US011189230B2

(12) United States Patent
Wang et al.

(10) Patent No.: US 11,189,230 B2
(45) Date of Patent: Nov. 30, 2021

(54) DISPLAY DEVICE, PIXEL COMPENSATION CIRCUIT AND DRIVING METHOD THEREOF

(71) Applicants: ORDOS YUANSHENG OPTOELECTRONICS CO., LTD., Ordos (CN); BOE TECHNOLOGY GROUP CO., LTD., Beijing (CN)

(72) Inventors: Zhichong Wang, Beijing (CN); Fuqiang Li, Beijing (CN); Jing Feng, Beijing (CN); Xinglong Luan, Beijing (CN); Peng Liu, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/768,395

(22) PCT Filed: Dec. 16, 2019

(86) PCT No.: PCT/CN2019/125705

§ 371 (c)(1),
(2) Date: May 29, 2020

(87) PCT Pub. No.: WO2020/147477

PCT Pub. Date: Jul. 23, 2020

(65) Prior Publication Data

US 2021/0210018 A1 Jul. 8, 2021

(30) Foreign Application Priority Data

Jan. 18, 2019 (CN) ..... 201910047322.4

(51) Int. Cl.
*G09G 3/3258* (2016.01)

(52) U.S. Cl.
CPC ..... *G09G 3/3258* (2013.01); *G09G 2330/028* (2013.01)

(58) Field of Classification Search
CPC .... G09G 3/3233; G09G 3/3241; G09G 3/325; G09G 3/3258; G09G 2300/0809;
(Continued)

(56) References Cited

U.S. PATENT DOCUMENTS 9,437,167 B2 9/2016 Shin et al.
9,786,723 B2 10/2017 Yang
(Continued)

FOREIGN PATENT DOCUMENTS

CN 104217679 12/2014
CN 104637443 5/2015
(Continued)

OTHER PUBLICATIONS

Chinese Office Action dated Mar. 27, 2020 corresponding to Chinese Patent Application No. 201910047322.4; 18 pages.

*Primary Examiner* — Tom V Sheng
(74) *Attorney, Agent, or Firm* — Leason Ellis LLP

(57) ABSTRACT

A display device, a pixel compensation circuit and a driving method thereof are disclosed. The pixel compensation circuit includes: a driving transistor, an initialization circuit, a storage circuit, a first data writing circuit, a second data writing circuit, a compensation circuit and a light emitting control circuit. A first terminal of the storage circuit is coupled to the gate electrode of the drive transistor, and the first data writing circuit is configured to write a data signal to a second terminal of the storage circuit. The second data writing circuit is configured to change a potential of the second terminal of the storage circuit so that a potential of the first terminal of the storage circuit is associated with the data signal. The compensation circuit is configured to charge
(Continued)

the first terminal of the storage circuit so that it is associated with a threshold voltage of the drive transistor.

10 Claims, 4 Drawing Sheets

(58) Field of Classification Search
CPC ... G09G 2300/0819; G09G 2320/0233; G09G 2320/045; G09G 2320/046; G09G 2330/028
USPC ..... 345/204
See application file for complete search history.

(56) References Cited

U.S. PATENT DOCUMENTS

| | | | | |
|---|---|---|---|---|
| 10,417,967 | B2 | 9/2019 | Zhu et al. | |
| 10,529,281 | B2 * | 1/2020 | Wang | G09G 3/3233 |
| 2011/0157135 | A1 * | 6/2011 | Lee | G09G 3/3291 345/211 |
| 2014/0132175 | A1 * | 5/2014 | Hokazono | G09G 3/3233 315/228 |
| 2014/0320544 | A1 | 10/2014 | Kim | |
| 2015/0170572 | A1 * | 6/2015 | Qing | G09G 3/3233 315/172 |
| 2015/0356924 | A1 * | 12/2015 | Chen | G09G 3/3258 345/690 |
| 2017/0221418 | A1 * | 8/2017 | Xiang | G09G 3/3233 |
| 2019/0180686 | A1 | 6/2019 | Qu et al. | |
| 2019/0197950 | A1 * | 6/2019 | Shibusawa | G09G 3/3233 |
| 2020/0202782 | A1 * | 6/2020 | Huangfu | G09G 3/3266 |
| 2020/0211452 | A1 * | 7/2020 | Lee | G09G 3/3233 |
| 2020/0243003 | A1 * | 7/2020 | Yang | G09G 3/3283 |
| 2020/0342813 | A1 * | 10/2020 | Gao | G09G 3/3258 |
| 2021/0065624 | A1 * | 3/2021 | Li | G09G 3/3291 |
| 2021/0097931 | A1 * | 4/2021 | Yue | G09G 3/325 |

FOREIGN PATENT DOCUMENTS

| | | |
|---|---|---|
| CN | 106652915 | 5/2017 |
| CN | 107093404 | 8/2017 |
| CN | 107358916 | 11/2017 |
| CN | 108039149 | 5/2018 |
| CN | 109785799 | 5/2019 |
| KR | 20120061146 | 6/2012 |
| KR | 20120070773 | 7/2012 |

* cited by examiner

DISPLAY DEVICE, PIXEL COMPENSATION CIRCUIT AND DRIVING METHOD THEREOF

This patent application is a U.S. National Phase Application under 35 U.S.C. § 371 of International Patent Application No. PCT/CN2019/125705, filed Dec. 16, 2019, which claims priority to the Chinese Patent Application No. 201910047322.4, filed on Jan. 18, 2019, all of which are incorporated by reference in their entireties.

TECHNICAL FIELD

The present disclosure relates to the technical field of display, in particular to a display device, a pixel compensation circuit and a driving method thereof.

BACKGROUND

As illustrated in FIG. 1, due to magnetic hysteresis effects of DTFT, when an existing organic light emitting diode (OLED) product switches to a gray-scale picture after lighting a black-and-white picture for a period of time, residue images will appear, and after another period of time, the residue images will disappear. Such a phenomenon is called a short-term residue image. Therefore, it is urgent to solve the short-term residue image problem caused by the magnetic hysteresis effect for OLED products.

SUMMARY

According to a first aspect of the present disclosure, at least one embodiment of the present disclosure provides a pixel compensation circuit, which comprises: a drive transistor; an initialization circuit, configured to write an initial signal to a light emitting element under control of a first control signal; a storage circuit, wherein a first terminal of the storage circuit is coupled to the gate electrode of the drive transistor; a first data writing circuit, configured to write a data signal to a second terminal of the storage circuit under control of a second control signal; a second data writing circuit, configured to change a potential of the second terminal of the storage circuit under control of a second write control signal, so that a potential of the first terminal of the storage circuit is associated with the data signal; a compensation circuit, configured to charge the first terminal of the storage circuit under control of the first control signal, so that the potential of the first terminal of the storage circuit is associated with a threshold voltage of the drive transistor; a light emitting control circuit, connected with the drive transistor and configured to form a current path flowing through a light emitting element under control of a light emitting control signal.

According to a second aspect of the present disclosure, at least one embodiment of the present disclosure provides a display device, which comprises the pixel compensation circuit described above.

According to a third aspect of the present disclosure, at least one embodiment of the present disclosure provides a method for driving a pixel compensation circuit, which comprises: in a first stage, writing an initial signal to a gate electrode and a source electrode of a drive transistor under control of a first control signal; in a second stage, writing a data signal to a second terminal of a storage circuit under control of a second control signal, changing the potential of the second terminal of the storage circuit under the control of the second control signal so that the potential of a first terminal of the storage circuit is associated with the data signal, and charging the first terminal of the storage circuit under control of a compensation control signal so that a potential of the first terminal of the storage circuit is associated with a threshold voltage of the drive transistor; and in the third stage, under the control of the light-emitting control signal, a current path is formed that flows through the light-emitting element.

Additional aspects and advantages of the present disclosure will be set forth in part in the following description, and in part will be apparent from the description, or may be learned by practice of the present disclosure.

BRIEF DESCRIPTION OF THE DRAWINGS

The above and/or additional aspects and advantages of the present disclosure will become apparent and readily understood from the following description of the embodiments taken in conjunction with the accompanying drawings, and wherein.

DETAILED DESCRIPTION

Figure 1:
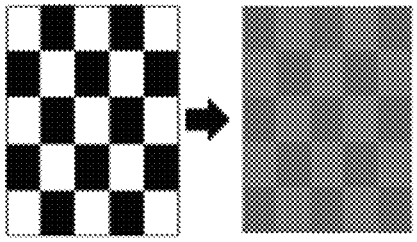
FIG. 1 is a schematic diagram illustrating the magnetic hysteresis effect.

Hereinafter, the embodiments of the present disclosure will be described in detail, examples of which are illustrated in the accompanying drawings, where the same or similar reference numerals refer to the same or similar elements or elements having the same or similar functions throughout. The embodiments described below by referring to the accompanying drawings are exemplary and are intended to explain the present disclosure, and should not be construed as limiting the present disclosure.

A display device, a pixel compensation circuit and a driving method thereof according to the embodiments of the present disclosure will be described with reference to the accompanying drawings.

The magnetic hysteresis effect and the reasons causing the short-term after images will be introduced hereinafter, in prior to the introduction of a pixel driving circuit for a display panel and a light emitting diode according to the embodiments of the present disclosure.

In the following embodiments, P-type thin film transistors will be taken as an example for illustrating. It should be understood that the present disclosure is not limited to this, and N-type thin film transistors may also be used.

Figure 2A:
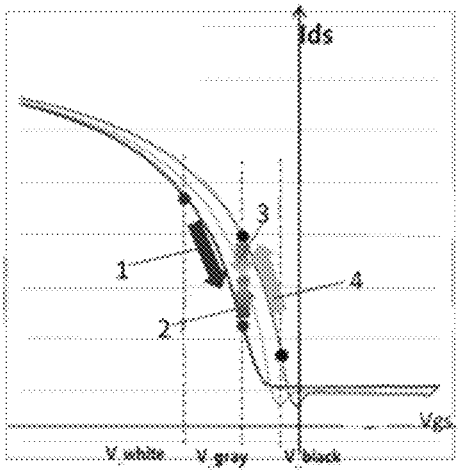
FIGS. 2A and 2B are schematic diagrams illustrating the principle of the magnetic hysteresis effect.
Figure 2B:
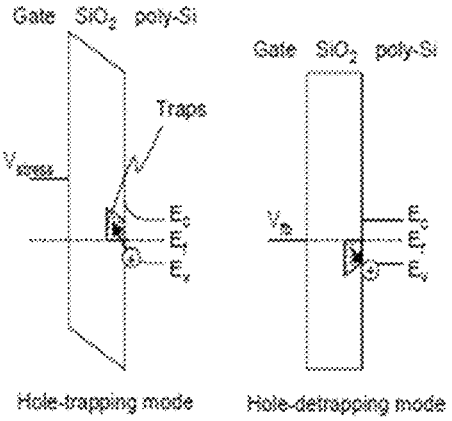

Specifically, as illustrated in FIG. 2A, hole detrapping occurs when an image changes from white to gray (e.g., arrows 1 and 2), or hole trapping occurs when the image changes from black to gray (as indicated by arrows 3 and 4). The magnetic hysteresis effect is mainly caused by a shift of a threshold voltage Vth resulting from the hole detrapping/trapping (or residual movable ions). In FIG. 2A, the smaller the gate-source voltage Vgs is, the more charges (holes in this embodiment) are trapped at the interface between the active layer and the gate insulating layer (ACT/GI), and thus, the threshold voltage Vth will be negatively biased. When the gate-source voltage Vgs gets larger, the charges (holes) trapped at the ACT/GI interface will be detrapped, and thus the threshold voltage Vth will be positively biased. In a currently used compensation circuit, because the gate-source voltages Vgs in the initialization phase are different when switching between different pictures, the states of holes trapping/detrapping are different, which results in short-term residue images. In addition, FIG. 2B is a schematic diagram of the hole-trapping mode and hole-detrapping mode, respectively.

To overcome the above-described problem, the present disclosure provides a pixel driving circuit for a display panel and a light emitting diode.

Figure 3:
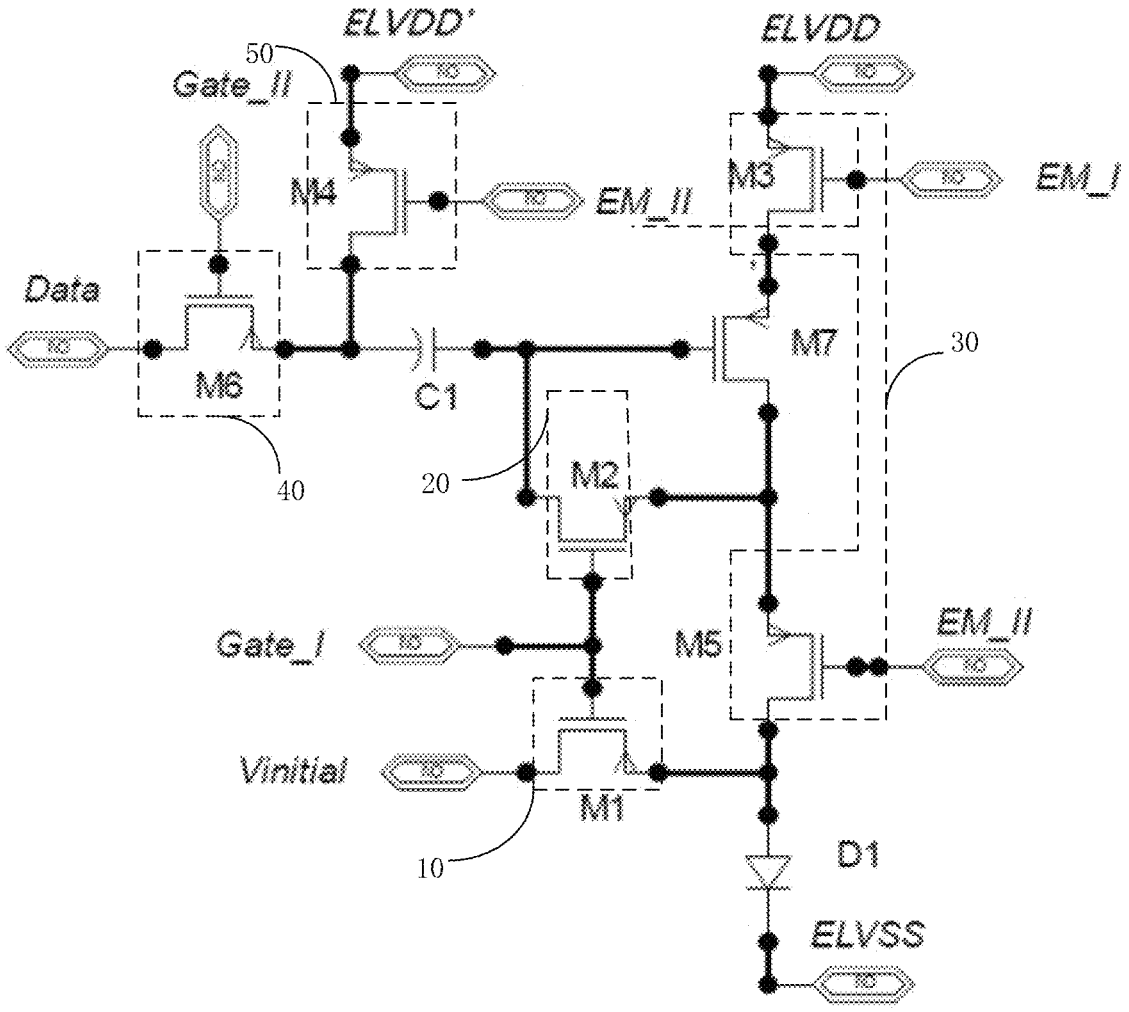
FIG. 3 is a circuit schematic diagram of a pixel compensation circuit according to one embodiment of the present disclosure.

FIG. 3 is a circuit schematic diagram of a pixel compensation circuit according to an embodiment of the present disclosure. As illustrated in FIG. 3, the pixel compensation circuit 100 of the embodiments of the present disclosure includes a drive transistor M7, an initialization circuit 10, a storage circuit C1, a first data writing circuit 40, a second data writing circuit 50, a compensation circuit 20, and a light emitting control circuit 30.

In the embodiment, the initialization circuit 10 writes an initial signal to the anode of the light emitting element D1 under the control of a first control signal. A first terminal of the storage circuit C1 is coupled to the gate electrode of the drive transistor M7. When the second transistor M2 and the fifth transistor M5 is turned on, the initial signal is written to the gate and source electrodes of the drive transistor M7 and the first terminal of the storage circuit 1. The first data writing circuit 40 writes a data signal to a second terminal of the storage circuit C1 under the control of a second control signal. The second data writing circuit 50 changes a potential of the second terminal of the storage circuit C1 under the control of a second write control signal so that a potential of the first terminal of the storage circuit C1 is associated with the data signal. The compensation circuit 20 charges the first terminal of the storage circuit C1 under the control of the first control signal, so that the potential of the first terminal of the storage circuit C1 is associated with a threshold voltage of the drive transistor M7. The light emitting control circuit 30 forms a current path flowing through a light emitting element D1 under the control of a light emitting control signal.

In the embodiment illustrated in FIG. 3, the light emitting control circuit 30 includes a third transistor M3 and a fifth transistor M5.

Further, as illustrated in FIG. 3, the light emitting control circuit 30 includes a first terminal to a fourth terminal, a first control terminal and a second control terminal. The first terminal of the light emitting control circuit 30 (i.e., a first terminal of the third transistor M3) is coupled to a first power supply ELVDD, the second terminal of the light emitting control circuit 30 (i.e., a second terminal of the third transistor M3) is coupled to a first terminal of the drive transistor M7, and the third terminal of the light emitting control circuit 30 (i.e., a first terminal of the fifth transistor M5) is coupled to a second terminal of the drive transistor M7, the fourth terminal of the light emitting control circuit 30 (i.e., a second terminal of the fifth transistor M5) is coupled to a first terminal of the light emitting element D1, the first control terminal of the light emitting control circuit 30 (i.e., a control terminal of the third transistor M3) is coupled to a first light emitting control terminal EM_I, and the second control terminal of the light emitting control circuit 30 (i.e., a control terminal of the fifth transistor M5) is coupled to a second light emitting control terminal EM_II. The light emitting control circuit 30 controls whether the first terminal and the second terminal of the light emitting control circuit 30 are turned on or not (i.e., controls whether the third transistor M3 is turned on or not) according to a first light emitting control signal, and also controls whether the third terminal and the fourth terminal of the light emitting control circuit 30 are turned on or not (i.e., controls whether the fifth transistor M5 is turned on or not) according to a second light emitting control signal.

Further, as illustrated in FIG. 3, the initialization circuit 10 includes a first transistor M1.

In the embodiment, a first electrode of the first transistor M1 is coupled to an initial signal terminal Vinitial, a second electrode of the first transistor M1 is coupled to the fourth terminal of the light emitting control circuit 30, and a control electrode of the first transistor M1 is coupled to a first control terminal Gate_I. The compensation circuit 20 includes a second transistor M2. A first electrode of the second transistor M2 is coupled to the control terminal of the drive transistor M7, a second electrode of the second transistor M2 is coupled to the third terminal of the light emitting control circuit 30 and the second terminal of the drive transistor M7, and a control electrode of the second transistor M2 is coupled to the first control terminal Gate_I.

The light emitting drive control circuit includes a fourth transistor M4.

In the embodiment, a first electrode of the fourth transistor M4 is coupled to a second power supply ELVDD', a second electrode of the fourth transistor M4 is coupled to a second terminal of the storage circuit C1, and a control electrode of the fourth transistor M4 is coupled to the second light emitting control terminal EM_II. It should be understood that the second write control signal may be the same control signal as the second light emitting control signal, and therefore, the control electrode of the fourth transistor M4 may be directly coupled to the second light emitting control terminal EM_II.

The first data writing circuit 40 includes a sixth transistor M6. A first electrode of the sixth transistor M6 is coupled to a data signal terminal Data, a second electrode of the sixth transistor M6 is coupled to a second terminal of the storage circuit C1, and a control electrode of the sixth transistor M6 is coupled to the second control terminal Gate_II.

The storage circuit C1 includes a storage capacitor, one terminal of the storage capacitor serves as a first terminal of the storage circuit C1, and the other terminal of the storage capacitor serves as a second terminal of the storage circuit C1.

Figure 4:
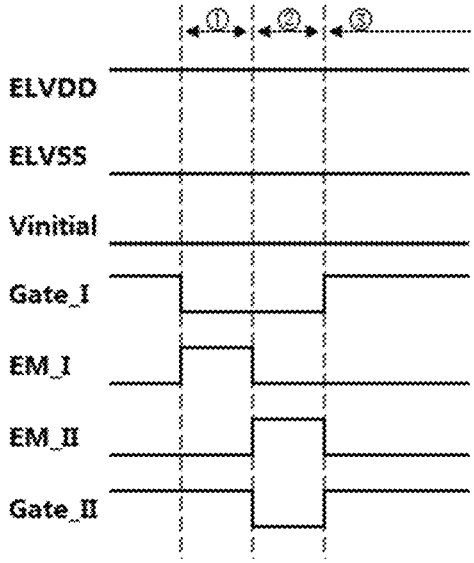
FIG. 4 is an operation timing diagram according to one embodiment of the present disclosure.
Figure 5:
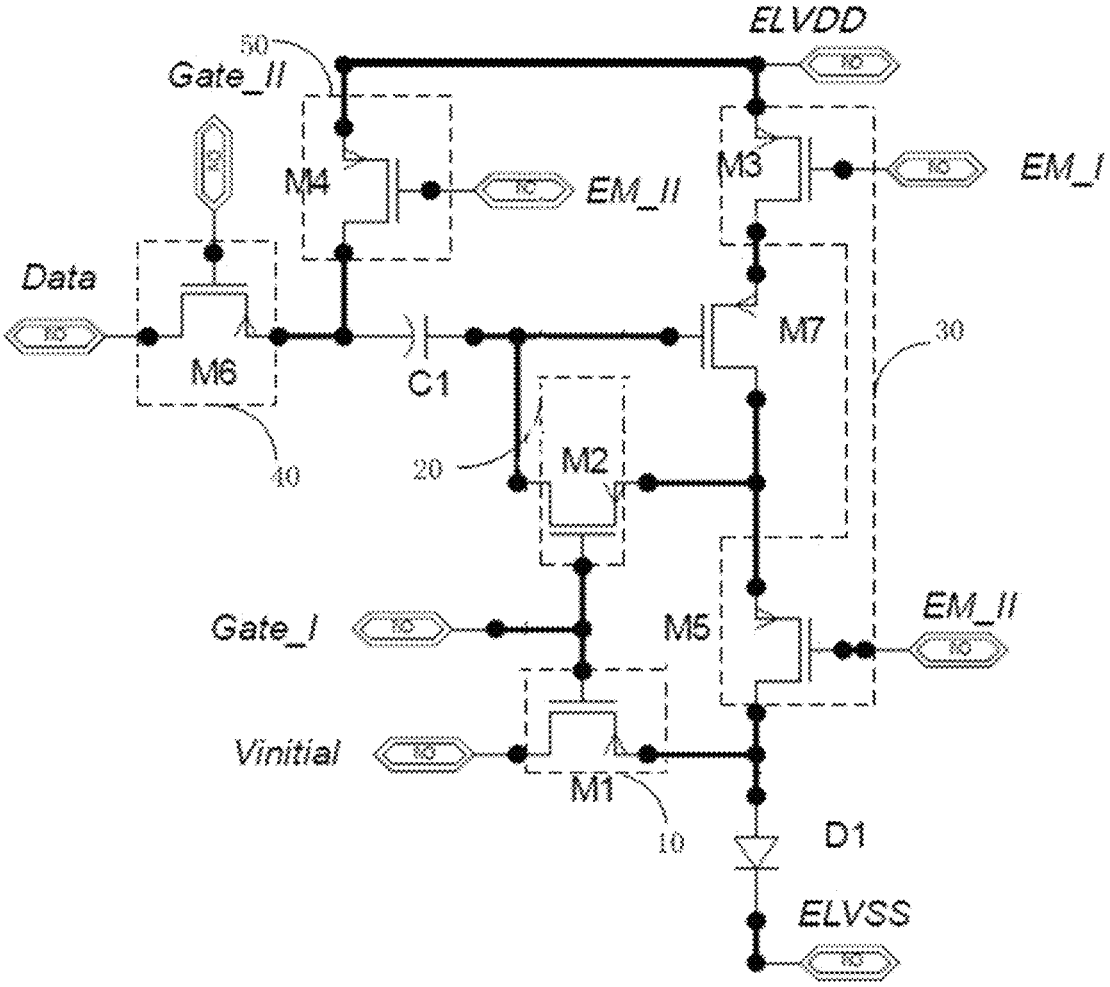
FIG. 5 is a circuit schematic diagram of a pixel compensation circuit according to another embodiment of the present disclosure.

It should be noted that in the embodiments of the present disclosure, the first control signal may include a signal provided by the first control terminal Gate_I and a signal provided by the second light emitting control terminal EM_II as illustrated in FIGS. 3-5, that is, the first control signal includes Gate_I and EM_II, so that under the control of the first control signal, the first transistor M1 and the second transistor M2 in the initialization circuit 10 are turned on under the control of Gate_I, and the fifth transistor M5 is turned on under the control of EM_II. Thus, an initial signal is written to the gate electrode and source electrode of the drive transistor which are coupled to the second transistor M2 and the fifth transistor M5, respectively.

It should also be understood that the first power supply can be ELVDD or ELVDD', etc., and the second power supply can also be ELVDD or ELVDD', etc. That is, the first power supply and the second power supply can input the same power signal or different power signals. In the case where the power signals input by the first power supply and the second power supply are the same, the first terminal of the light emitting control circuit and the second electrode of the fourth transistor M4 in the second data writing circuit 50 can be coupled together and then coupled to the first power supply or the second power supply, as illustrated in FIG. 5. In the case where the power signals input by the first power supply and the second power supply are different, the first terminal of the light emitting control circuit 30 and the second electrode of the fourth transistor M4 in the second data writing circuit 50 can be coupled to the first power supply and the second power supply, respectively, as illustrated in FIG. 3. In the embodiment illustrated in FIG. 5, the first power supply and the second power supply are both ELVDD. In the embodiment illustrated in FIG. 3, the first power supply is ELVDD and the second power supply is ELVDD'.

Further, in the embodiments illustrated in FIGS. 3 and 5, transistors in the initialization circuit 10, the light emitting control circuit 30, the first data writing circuit 40, the second data writing circuit 50, and the compensation circuit 20 are all p-type transistors. It should also be understood that the transistors in the initialization circuit 10, the light emitting control circuit 30, the first data writing circuit 40, the second data writing circuit 50, and the compensation circuit 20 may all be N-type transistors, which may depend on actual situations.

The operation principle of the compensation circuit of the embodiments of the present disclosure will be further explained below by taking as examples that the transistors in the circuit illustrated in FIG. 5 are all p-type transistors, the input signals of the first power supply and the second power supply are the same, and the first power supply is ELVDD. The operation timing of the pixel compensation circuit of the light emitting diode D1 of the embodiments of the present disclosure may be as illustrated in FIG. 4. According to the embodiments of the present disclosure, the light emitting element D1 may be an organic light emitting diode (OLED).

It can be understood that in a first stage, i.e. an initialization stage, as illustrated in stage ① of FIG. 4, signals of the first control terminal Gate_I and the second light emitting control terminal EM_II are at a first level, and the first level is a valid level, so that the first transistor M1 and the second transistor M2, the fourth transistor M4 and the fifth transistor M5 are all turned on. Signals of the second control terminal Gate_II and the first light emitting control terminal EM_I are at a second level, and the second level is an invalid level, so that the sixth transistor M6 and the third transistor M3 are turned off. In this stage, because the first transistor M1, the second transistor M2, the fourth transistor M4, and the fifth transistor M5 are all in the on state, an initial level of the initial signal terminal Vinitial is applied to the gate electrode of the drive transistor M7, so that a voltage of the gate electrode of the drive transistor M7 is initialized, and thus a fixed bias starting point is realized, thereby improving the short-term residue image caused by the magnetic hysteresis effect. Meanwhile, the initial signal at this stage also resets the anode voltage of the light emitting element D1.

In a second stage, as illustrated in stage ② in FIG. 4, signals of the first control terminal Gate_I, the second control terminal Gate_II and the first light emitting control terminal EM_I are at a first level, while signals of the second light emitting control terminal EM_II is at a second level, and the first level is a valid level and the second level is an invalid level. In this stage, under the action of the second control terminal Gate_II, the sixth transistor M6 is in an on state, and a data signal of the data signal terminal Data is written to the second terminal of the storage circuit C1. Under the action of the first control terminal Gate_I and the first light emitting control terminal EM_I, the third transistor M3 of the light emitting control circuit 30, the drive transistor M7 and the second transistor M2 of the compensation circuit 20 are in a turned-on state, so that the first power supply ELVDD can charge the first terminal of the storage circuit C1 until the voltage at the first terminal of the storage circuit C1 is ELVDD+Vth, that is, the threshold voltage of the drive transistor M7 is written into the first terminal of the storage circuit C1 so as to compensate the threshold voltage of the drive circuit. Meanwhile, at this stage, under the action of the first control terminal Gate_I, the first transistor M1 maintains the turned-on state, and the initial signal Vinitial continuously resets the anode voltage of the light emitting element D1.

In a third stage, as illustrated in stage ③ in FIG. 4, signals of the first control terminal Gate_I and the second control terminal Gate_II are at a second level, and signals of the first light emitting control terminal EM_I and the second light emitting control terminal EM_II are at a first level, and the first level is a valid level and the second level is an invalid level. In this stage, the fourth transistor M4 is in an on state, and the voltage at the second terminal of the storage circuit C1 changes to ELVDD, which results in that a voltage at the first terminal of the storage circuit C1 changes to ELVDD+Vth+(EL VDD−Vdata)=2ELVDD+Vth−Vdata. Therefore, in this stage, the gate-source voltage Vgs of the drive transistor M7 satisfies: Vgs=ELVDD+Vth−Vdata. The third transistor M3, the drive transistor M7, and the fifth transistor M5 are all turned on, a path is formed between the first power supply ELVDD and the light emitting element D1, and the light emitting element D1 emits light.

In the embodiments of the present disclosure, an OLED is a current driving device, and the current formula is $I=\frac{1}{2}K(Vgs-Vth)^2=\frac{1}{2}K(ELVDD-Vdata)^2$, where K is a coefficient. Thus, it can be seen that the pixel compensation circuit can realize the compensation of Vth.

Accordingly, in the embodiment illustrated in FIG. 3, in the third stage, a gate potential of the drive transistor M7 is coupled to become ELVDD+Vth+(ELVDD'−Vdata). Therefore, in this stage, the gate-source voltage Vgs of the drive transistor M7 satisfies: Vgs=ELVDD'+Vth−Vdata. The current formula is $I=\frac{1}{2}K(Vgs-Vth)^2=\frac{1}{2}K(ELVDD'-Vdata)^2$. It should be understood that the present disclosure can use either P-type transistors or N-type transistors. In the case where the transistors in the initial circuit 10, the light emitting control circuit 30, the first data writing circuit 40, the second data writing circuit 50 and the compensation circuit 20 are all P-type transistors, the first level signal is a low level signal and the second level signal is a high level signal. In the case where the transistors in the initial circuit 10, the light emitting control circuit 30, the first data writing circuit 40, the second data writing circuit 50, and the compensation circuit 20 are all N-type transistors, the first level signal is a high level signal, and the second level is a low level signal.

In summary, in the pixel compensation circuit according to the embodiments of the present disclosure, the initialization circuit is turned on according to the first control signal before writing the data signal, so that the initial signal terminal writes the initial signal to the anode of the light emitting element, and after writing the data signal, the potential of the first terminal of the storage circuit is associated with the threshold voltage of the drive transistor according to the compensation control signal. Therefore, the pixel compensation circuit of the embodiments of the present disclosure can enable the drive circuit to start data writing and compensation from a fixed bias state, greatly improving the short-term residue image problem caused by the magnetic hysteresis effect, and effectively improving user experience.

Figure 6:
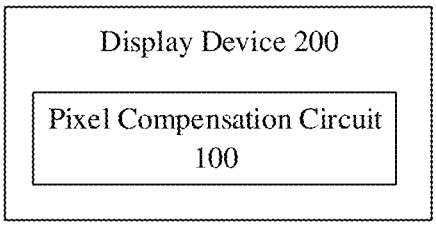
FIG. 6 is a block diagram of a display device according to one embodiment of the present disclosure.

FIG. 6 is a block diagram of a display device according to one embodiment of the present disclosure. As illustrated in FIG. 6, a display device 200 according to the embodiments of the present disclosure includes a pixel compensation circuit 100.

Figure 7:
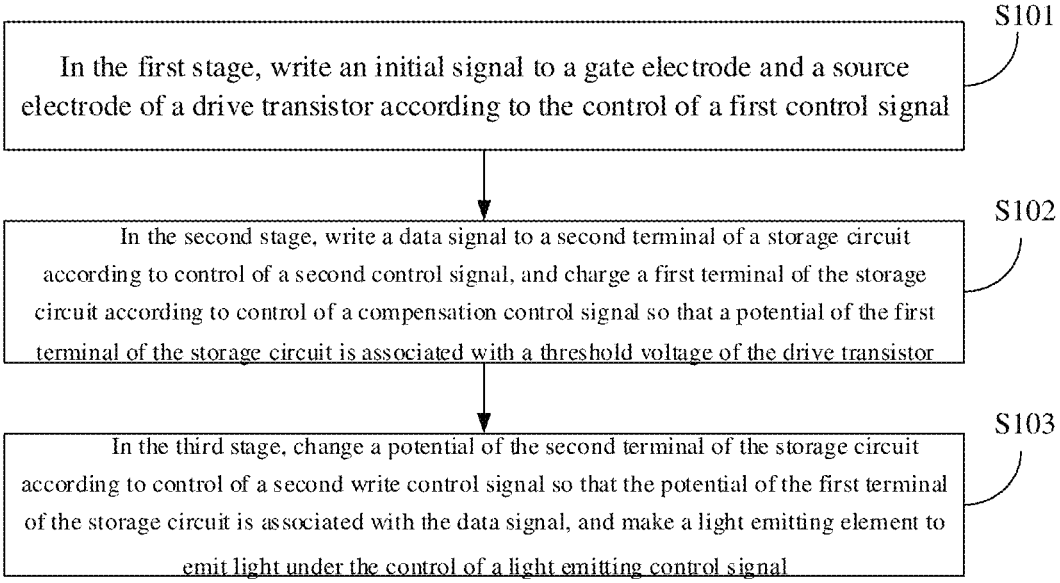
FIG. 7 is a flowchart of a method for driving a pixel compensation circuit according to one embodiment of the present disclosure.

FIG. 7 is a flowchart of a method for driving a pixel compensation circuit according to one embodiment of the present disclosure. As illustrated in FIG. 7, this method for driving the pixel compensation circuit according to the embodiments of the present disclosure includes the steps as follows.

S101: in the first stage, an initial signal is written to a gate electrode and a source electrode of a drive transistor under the control of a first control signal.

S102: in the second stage, a data signal is written to a second terminal of a storage circuit under the control of a second control signal, and a first terminal of the storage circuit is charged under the control of a compensation control signal, so that a potential of the first terminal of the storage circuit is associated with a threshold voltage of the drive transistor.

S103: in the third stage, a potential of the second terminal of the storage circuit is changed under the control of a second write control signal, so that the potential of the first terminal of the storage circuit is associated with the data signal, and a light emitting element emits light under the control of a light emitting control signal.

It should be noted that the above-described explanation of the embodiments of the method for driving the pixel compensation circuit is also applicable to the pixel compensation circuit of this embodiment and will not be repeated here.

In the description of this specification, the description referring to the terms "an embodiment," "some embodiments," "examples," "specific examples," or "some examples" and the like means that specific features, structures, materials, or characteristics described in connection with the embodiments or examples are included in at least one embodiment or example of the present disclosure. In this specification, the schematic representation of the above-mentioned terms does not necessarily refer to a same embodiment or example. Moreover, the specific features, structures, materials, or characteristics described may be combined in any one or more embodiments or examples in an applicable manner. In addition, in case of no conflict, those skilled in the art can combine and incorporate different embodiments or examples described in this specification and features in the different embodiments or examples.

Furthermore, the terms "first" and "second" are used for the purpose of illustrating only and cannot be understood as indicating or implying relative importance or implicitly indicating the number of technical features indicated. Thus, the features defining "first" and "second" may explicitly or implicitly include at least one of the features. In the description of the present disclosure, the meaning of "a plurality of" is at least two, such as two, three, etc., unless otherwise specifically defined.

Any process or method in the flowchart or otherwise described herein can be understood as representing a module, segment, or portion of code that includes one or more executable instructions for implementing customized logical functions or steps of the process. The scope of preferred embodiments of the present disclosure includes additional implementations in which functions may be performed out of the order illustrated or discussed, including in a substantially simultaneous manner or in the reverse order depending on the functions involved, which should be understood by those skilled in the art to which the embodiments of the present disclosure belong.

The logic and/or steps represented in the flowchart or otherwise described herein, for example, may be considered as a fixed sequence table of executable instructions for implementing logical functions, and may be embodied in any computer readable medium for use by or in connection with an instruction execution system, apparatus, or device (e.g., a computer-based system, a system including a processor, or other system that can fetch and execute instructions from the instruction execution system, apparatus, or device). For this specification, "computer readable medium" may be any device that can contain, store, communicate, propagate, or transport the program for use by or in connection with the instruction execution system, apparatus, or device. More specific examples (non-exhaustive list) of computer readable media include the following: an electrical connector (electronic device) having one or more wires, a portable computer disk cartridge (magnetic device), a random access memory (RAM), a read only memory (ROM), an erasable editable read only memory (EPROM or flash memory), an optical fiber device, and a portable optical disk read only memory (CDROM). In addition, the computer readable medium may even be paper or other applicable medium on which the program can be printed, because the program can be electronically obtained, for example, by optically scanning the paper or other medium, followed by editing, interpreting, or processing in other applicable ways if necessary, and then stored in a computer memory.

It should be understood that various parts of the present disclosure may be implemented in hardware, software, firmware, or a combination thereof. In the above embodiments, the plurality of steps or methods may be implemented in software or firmware stored in a memory and executed by an applicable instruction execution system. For example, if implemented in hardware is the same as in another embodiment, it can be implemented by any one or a combination of the following technologies known in the art: discrete logic circuits having a logic gate circuit for implementing logic functions on data signals, application specific integrated circuits having an appropriate combinational logic gate circuit, programmable gate arrays (PGA), field programmable gate arrays (FPGA), etc.

One of ordinary skill in the art can understand that all or part of the steps included in the method for implementing the above embodiments can be completed by instructing relevant hardware through a program, which can be stored in a computer readable storage medium, and the program, when executed, includes one or a combination of the steps of these method embodiments.

In addition, each functional unit in each embodiment of the present disclosure may be integrated into one processing module, each unit may be physically present separately, or two or more units may be integrated into one module. The above integrated modules can be implemented in the form of hardware or software functional modules. If the integrated module is implemented in the form of a software functional module and sold or used as an independent product, it may also be stored in a computer readable storage medium.

The storage medium mentioned above may be a read-only memory, magnetic disk or optical disk, etc. Although the embodiments of the present disclosure have been illustrated and described above, it can be understood that the above-mentioned embodiments are exemplary and should not be construed as limiting the present disclosure, and those of ordinary skill in the art may make changes, modifications, substitutions and variations to the above-mentioned embodiments within the scope of the present disclosure.

What is claimed is:

1. A pixel compensation circuit, comprising:

a drive transistor;

an initialization circuit, configured to write an initial signal to a light emitting element under control of a first control signal;

a storage circuit, wherein a first terminal of the storage circuit is coupled to a gate electrode of the drive transistor;

a first data writing circuit, configured to write a data signal to a second terminal of the storage circuit under control of a second control signal;

a second data writing circuit, configured to change a potential of the second terminal of the storage circuit under control of a second write control signal, so that a potential of the first terminal of the storage circuit is associated with the data signal;

a compensation circuit, configured to charge the first terminal of the storage circuit under control of the first control signal, so that the potential of the first terminal of the storage circuit is associated with a threshold voltage of the drive transistor;

a light emitting control circuit, connected with the drive transistor and configured to form a current path flowing through a light emitting element under control of a light emitting control signal;

wherein the light emitting control circuit comprises a first terminal, a second terminal, a third terminal, a fourth terminal, a first control terminal and a second control terminal; and wherein the first terminal of the light emitting control circuit is coupled to a first power supply, the second terminal of the light emitting control circuit is coupled to a first terminal of the drive transistor, the third terminal of the light emitting control circuit is coupled to a second terminal of the drive transistor, the fourth terminal of the light emitting control circuit is coupled to the light emitting element, the first control terminal of the light emitting control circuit is coupled to a first light emitting control terminal, and the second control terminal of the light emitting control circuit is coupled to a second light emitting control terminal; and the light emitting control circuit controls the first terminal and the second terminal of the light emitting control circuit to be conducted according to a first light emitting control signal, and also controls the third terminal and the fourth terminal of the light emitting control circuit to be conducted according to a second light emitting control signal.

2. The pixel compensation circuit according to claim 1, wherein the light emitting control circuit comprises a third transistor and a fifth transistor, wherein a first terminal of the third transistor is coupled to a first power supply terminal, a second terminal of the third transistor is coupled to a first terminal of the drive transistor, a first terminal of the fifth transistor is coupled to a second terminal of the drive transistor, a second terminal of the fifth transistor is coupled to a first terminal of the light emitting element, a control terminal of the third transistor is coupled to a first light emitting control terminal, and a control terminal of the fifth transistor is coupled to a second light emitting control terminal.

3. The pixel compensation circuit according to claim 1, wherein the initialization circuit comprises:

a first transistor, wherein a first electrode of the first transistor is coupled to an initial signal terminal, a second electrode of the first transistor is coupled to a fourth terminal of the light emitting control circuit, and a control electrode of the first transistor is coupled to a first control terminal.

4. The pixel compensation circuit according to claim 1, wherein the compensation circuit comprises:

a second transistor, wherein a first electrode of the second transistor is coupled to the gate electrode of the drive transistor, a second electrode of the second transistor is coupled to a third terminal of the light emitting control circuit, and a control electrode of the second transistor is coupled to the first control terminal.

5. The pixel compensation circuit according to claim 1, wherein the first data writing circuit comprises a sixth transistor, and a first electrode of the sixth transistor is coupled to a data signal terminal, a second electrode of the sixth transistor is coupled to the second terminal of the storage circuit, and a control electrode of the sixth transistor is coupled to a second control terminal.

6. The pixel compensation circuit according to claim 1, wherein the second data writing circuit comprises a fourth transistor, and a first electrode of the fourth transistor is coupled to a second power supply, a second electrode of the fourth transistor is coupled to the second terminal of the storage circuit, and a control electrode of the fourth transistor is coupled to a second light emitting control terminal.

7. The pixel compensation circuit according to claim 1, wherein the storage circuit comprises a storage capacitor, and one terminal of the storage capacitor serves as the first terminal of the storage circuit, and the other terminal of the storage capacitor serves as the second terminal of the storage circuit.

8. A display device, comprising the pixel compensation circuit according to claim 1.

9. A method for driving a pixel compensation circuit, comprising:

in a first stage, writing an initial signal to a gate electrode and a source electrode of a drive transistor under control of a first control signal;

in a second stage, writing a data signal to a second terminal of a storage circuit under control of a second control signal, and charging a first terminal of the storage circuit under control of a compensation control signal so that a potential of the first terminal of the storage circuit is associated with a threshold voltage of the drive transistor; and in a third stage, changing a potential of the second terminal of the storage circuit under control of a second write control signal, so that the potential of the first terminal of the storage circuit is associated with the data signal and a light emitting element emits light under control of a light emitting control signal.

10. A pixel compensation circuit, comprising:

a drive transistor;

a light emitting control circuit, comprising a third transistor and a fifth transistor, a first terminal of the third transistor is coupled to a first power supply terminal, a second terminal of the third transistor is coupled to a first terminal of the drive transistor, a first terminal of the fifth transistor is coupled to a second terminal of the drive transistor, a second terminal of the fifth transistor is coupled to a first terminal of a light emitting element, a control terminal of the third transistor is coupled to a first light emitting control terminal, and a control terminal of the fifth transistor is coupled to a second light emitting control terminal;

an initialization circuit, comprising a first transistor, wherein a first electrode of the first transistor is coupled to an initial signal terminal, a second electrode of the first transistor is coupled to a fourth terminal of the light emitting control circuit, and a control electrode of the first transistor is coupled to a first control terminal;

a storage circuit, wherein a first terminal of the storage circuit is coupled to a gate electrode of the drive transistor, the storage circuit comprises a storage capacitor, and one terminal of the storage capacitor serves as the first terminal of the storage circuit, and an other terminal of the storage capacitor serves as a second terminal of the storage circuit;

a first data writing circuit, wherein the first data writing circuit comprises a sixth transistor, and a first electrode of the sixth transistor is coupled to a data signal terminal, a second electrode of the sixth transistor is coupled to the second terminal of the storage circuit, and a control electrode of the sixth transistor is coupled to a second control terminal;

a second data writing circuit, wherein the second data writing circuit comprises a fourth transistor, and a first electrode of the fourth transistor is coupled to a second power supply, a second electrode of the fourth transistor is coupled to the second terminal of the storage circuit, and a control electrode of the fourth transistor is coupled to the second light emitting control terminal; and a compensation circuit, wherein the compensation circuit comprises a second transistor, wherein a first electrode of the second transistor is coupled to a gate electrode of the drive transistor, a second electrode of the second transistor is coupled to a third terminal of the light emitting control circuit, and a control electrode of the second transistor is coupled to the first control terminal.

* * * * *